US007163053B2

(12) United States Patent
Nakamura et al.

(10) Patent No.: US 7,163,053 B2
(45) Date of Patent: Jan. 16, 2007

(54) HEAT EXCHANGER

(75) Inventors: Yoshio Nakamura, Nagano (JP); Yoshio Otsuka, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 205 days.

(21) Appl. No.: 10/825,744

(22) Filed: Apr. 16, 2004

(65) Prior Publication Data

US 2004/0194937 A1 Oct. 7, 2004

Related U.S. Application Data

(63) Continuation of application No. 10/007,820, filed on Dec. 5, 2001, now abandoned.

(30) Foreign Application Priority Data

Dec. 21, 2000 (JP) ..... 2000-389115

(51) Int. Cl.
*F28D 7/10* (2006.01)
*B21D 53/02* (2006.01)

(52) U.S. Cl. ..... 165/154; 165/299; 165/905; 29/890.03; 29/890.036; 29/56.5

(58) Field of Classification Search ..... 165/154, 165/905, 916, 133, 299; 29/890.03, 890.036, 29/56.5, 890.128
See application file for complete search history.

(56) References Cited

U.S. PATENT DOCUMENTS

| | | | | |
|---|---|---|---|---|
| 4,730,094 A * | 3/1988 | Aramaki et al. | ..... | 204/224 M |
| 4,789,506 A | 12/1988 | Kasprzyk | | |
| 5,238,057 A | 8/1993 | Shelter et al. | | |

FOREIGN PATENT DOCUMENTS

| | | |
|---|---|---|
| DE | 38 31 812 A | 3/1990 |
| EP | 0 528 411 A | 2/1993 |
| EP | 0 744 587 A | 11/1996 |
| GB | 1 504 702 A | 3/1978 |
| JP | 1 018974 | 1/1989 |

* cited by examiner

*Primary Examiner*—Ljiljana Ciric
(74) *Attorney, Agent, or Firm*—Jordan and Hamburg LLP

(57) ABSTRACT

A method for adjusting temperature of a machining liquid, e.g., slurry, etching liquid, by passing the machining liquid through a heat exchanger. The heat exchanger, which adjusts the temperature of the machining liquid, includes a ceramic heat exchanging tube which is made by baking silicon carbide (SiC).

20 Claims, 4 Drawing Sheets

HEAT EXCHANGER

CROSS-REFERENCE TO RELATED APPLICATION

This application is a continuation of U.S. patent application Ser. No. 10/007,820 filed Dec. 5, 2001, now abandoned, the specification of which is incorporated by reference herein.

FIELD OF THE INVENTION

The present invention relates to a heat exchanger, and more precisely to a heat exchanger capable of adjusting temperature of a machining liquid, e.g., slurry of abrading or cutting work pieces.

BACKGROUND OF THE INVENTION

In the case of abrading silicon wafers, the silicon wafers are abraded by, for example, an abrasive machine 10 shown in FIG. 2. In the abrasive machine 10, abrasive cloth 14 is adhered on a rotating abrasive plate 12. A silicon wafer 16 is pressed onto the abrasive cloth 14 by an abrasive head 20 so that a surface of the silicon wafer 16 can be abraded. Slurry including abrasive grains is supplied to the surface of the silicon wafer 16, and the used slurry is collected to be reused.

Namely, the slurry, in which abrasive grains are mixed, is dropped onto the abrasive cloth 14 so as to abrade the surface of the wafer 16, then the slurry is discharged from the abrasive cloth 14 to a collecting section 18 which is provided outside of the abrasive plate 12. The slurry discharged to the collecting section 18 has been heated by friction between the surface of the wafer 16 and the abrasive cloth 14, so the discharged slurry must be cooled, by a heat exchanger "H", until reaching a prescribed temperature. Then, abraded dusts included in the discharged slurry, which has been cooled, are removed by a removing unit 22. The slurry, from which the abraded dusts have been removed, is stored in a tank 24, and the slurry in the tank 24 is supplied to the abrasive cloth 14 again, by a pump 26, via an electromagnetic valve 28.

By providing the heat exchanger "H" in a circulation circuit of the slurry, the temperature of the slurry in the tank 24 can be maintained at a prescribed temperature, and the silicon wafers 16 can be abraded at a fixed abrasive rate without heat-deformation of the abrasive plate 12. In some cases, etching liquid is used as the machining liquid. Generally, the etching function of the etching liquid highly depends on temperature. If the temperature of the etching liquid is high, the etching function is sharply increased, so it is difficult to control the etching rate.

The abrasive plate 12 is heated by frictional heat between the surface of the wafer 16 and the abrasive cloth 14, and the abrasive plate 12 deforms when the abrasive plate 12 is overheated, so that accuracy of abrading the surface of the wafer 16 becomes low.

By providing the heat exchanger "H" so as to maintain the temperature of the slurry in the tank 24, the sharp increase of the etching function can be prevented, so that the etching rate can be easily controlled. Further, the heat of the liquid supplied to the abrasive plate 12 can be removed, so that the heat-deformation of the abrasive plate 12 can be prevented. The wafers 16 can be stably abraded with high abrasive accuracy.

A conventional heat exchanger "H" is shown in FIG. 5. The heat exchanger 180 is a double-tube type including: an inner heat exchanging tube 100 in which the discharged slurry flows; and an outer tube 102 in which cooling water flows along an outer circumferential face of the inner heat exchanging tube 100. The inner heat exchanging tube 100 is a fluororesin tube or a stainless tube coated with fluororesin and the outer tube 102 is made of vinyl chloride. As clearly shown in FIG. 5, an inlet 104 and an outlet 106 of the discharged slurry, which are provided to the heat exchanging tube 100, and an inlet 108 and an outlet 110 of the cooling water, which are provided to the outer tube 102, are arranged so as to flow the discharged slurry and the cooling water as countercurrents.

In the abrasive machine shown in FIG. 3, which has the heat exchanger "H", the discharged slurry heated by the frictional heat can be cooled. Even if the slurry is circulated to reuse, the wafers 16 can be stably abraded.

However, heat conductivity of the heat exchanging tube 100 made of a fluororesin is low. Therefore, a broad heat conductive area is required so as to properly remove the heat, with the result that the heat exchanger 180 must be large. If the heat exchanger 180 is large, the residence time of the machining liquid in the heat exchanger 180 must long, so that accuracy of controlling the temperature of the machining liquid, e.g., slurry, etching liquid, is low, the abrasive plate 12 deforms, and the etching function of the etching liquid is adversely affected.

In the case of the stainless heat exchanging tube which is not coated with fluororesin, the heat conductivity is high, so the heat conductive area can be small and size of the heat exchanger can be small.

However, metal ions solved out from the stainless tube stick onto the surface of the silicon wafer 16 to be abraded so that the function of the semiconductor chips is adversely affected.

OBJECTS AND SUMMARY OF THE INVENTION

An object of the present invention is to provide a heat exchanger which includes a heat exchanging tube whose heat conductivity is greater than that of the conventional fluororesin tube and from which no metal ions are solved out, and which is capable of easily adjusting temperature of a machining liquid, e.g., slurry, etching liquid.

The inventors of the present invention studied and found that the heat conductivity of a ceramic, which is made by baking silicon carbide, is 250 times as much as that of polytetrafluoroethylene, which is an example of fluororesin, and 4.5 times as much as stainless steel, and no metal ions are solved out from the ceramic.

Then, the inventors found that the heat exchanging tube made of the ceramic, which is made by baking silicon carbide (SiC), can be effectively used.

Namely, the heat exchanger of the present invention, which adjusts the temperature of a machining liquid, comprises: a ceramic heat exchanging tube, which is made by baking silicon carbide (SiC).

In the heat exchanger, the ceramic heat exchanging tube may not include boron (B). With this structure, no boron (B) solved out from the heat exchanging tube is included in the machining liquid, such that the surface of the work piece, e.g., silicon wafer, is not contaminated.

The heat exchanger may further comprise inlets and outlets of the machining liquid and a liquid for adjusting temperature, and the inlets and outlets make the machining liquid and the liquid for adjusting the temperature flow as countercurrents. With this structure, the temperature of the machining liquid can be easily adjusted.

In the heat exchanger of the present invention, the heat exchanging tube is the ceramic tube made by baking silicon carbide (SiC). The heat conductivity of the ceramic is highly greater than that of fluororesin and stainless steel, and no metal ion are solved into the machining liquid.

Therefore, heat exchange between the machining liquid and the temperature-adjusting liquid can be rapidly executed, and the temperature of the machining liquid can be easily adjusted.

Unlike the conventional heat exchanger including the fluororesin heat exchanging tube, the heat conductive area of the ceramic heat exchanging tube can be small and the size of the heat exchanger can be small. Therefore, the residence time of the machining liquid in the heat exchanger of the present invention can be shorter, and the temperature of the machining liquid can be precisely adjusted. Further, the rate of abrading or cutting work pieces can be easily controlled, and flatness of abraded faces or cut faces of the work pieces can be improved.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

Figure 1:
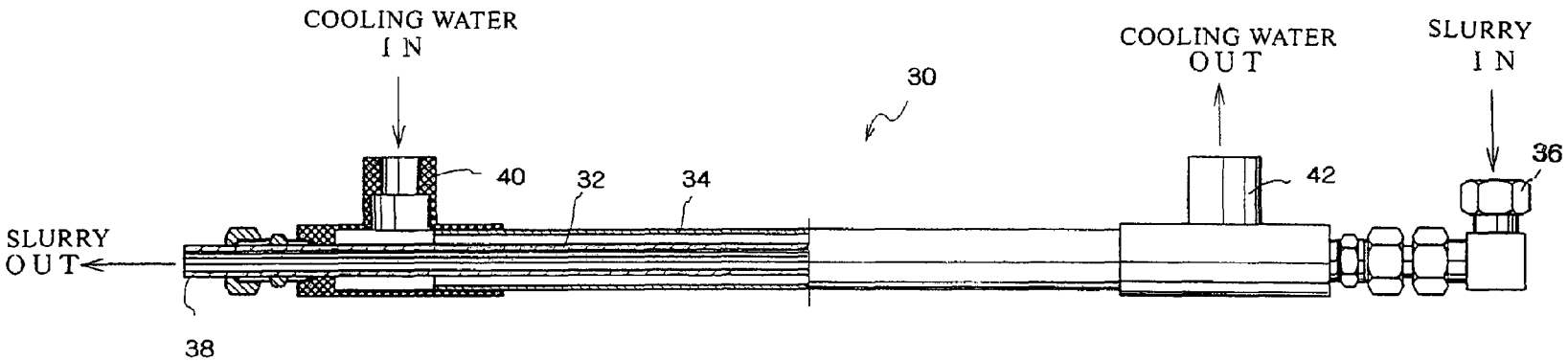
FIG. 1 is a partial sectional view of a heat exchanger in accordance with the present invention.

An embodiment of the heat exchanger of the present invention is shown in FIG. 1. The heat exchanger 30 shown in FIG. 1 has a double-tube structure. Namely, the heat exchanger 30 includes: an inner ceramic heat exchanging tube 32 in which slurry including abrasive grains flows; and an outer tube 34 which covers the inner heat exchanging tube 32 and in which cooling water (the temperature-adjusting liquid) flows along an outer circumferential face of the inner heat exchanging tube 32. The inner heat exchanging tube 32 is made of a ceramic made by baking silicon carbide (SiC) and the outer tube 34 is made of vinyl chloride or fluororesin. The slurry, which is an example of machining liquid and which flows in the heat exchanging tube 32, and the cooling water, which flows in a flow path formed between an inner circumferential face of the outer tube 34 and the outer circumferential face of the inner heat exchanging tube 32, may flow in the same direction. In the present embodiment, as clearly shown in FIG. 1, an inlet 36 and an outlet 38 of the slurry, which are provided to the heat exchanging tube 32, and an inlet 40 and an outlet 42 of the cooling water, which are provided to the outer tube 34, are arranged so as to flow the slurry and the cooling water as countercurrents. By forming the countercurrents, the temperature of the slurry can be easily adjusted in the present embodiment.

Connectors, which are made of vinyl chloride or fluororesin, are respectively attached to the inlet 36 and the outlet 38 of the ceramic heat exchanging tube 32, and fluororesin tubes (not shown) are respectively connected to the connectors.

The ceramic heat exchanging tube 32 of the heat exchanger 30 shown in FIG. 1 is made by baking silicon carbide (SiC) and includes no boron (B).

The process of forming the ceramic heat exchanging tube 32 will now be explained. First, powders of silicon carbide and resin, e.g., phenolic resin, are mixed, then the mixture is formed into a tube (a green tube). The green tube is degreased and carbonized in a nitrogen atmosphere, then it is baked. The baking process comprises the steps of: heating the tube, under highly vacuumed condition, until reaching a first temperature; introducing argon gas so as to make an argon atmosphere; further heating the tube, in the argon atmosphere, until reaching a second temperature higher than the first temperature; maintaining the second temperature for a prescribed period of time; and cooling the baked tube.

The ceramic tube 32 is made by baking silicon carbide (SiC) without adding boron (B). The bending strength (1000° C. or more) of the baked tube 32 is lower than that of a baked tube including boron (B), but the maximum temperature of the slurry, which is frictionally heated in the abrasive machine, is about 60° C., so the ceramic tube 32 has enough strength and function as the heat exchanging tube of the heat exchanger 30.

The ceramic made by baking silicon carbide (SiC) has a high heat conductivity, which is 250 times as much as that of polytetrafluoroethylene, which is an example of fluororesin, and 4.5 times as much as stainless steel. Therefore, the heat exchange between the slurry, which flows in the ceramic tube 32, and the cooling water, which flows in the flow path formed between the inner circumferential face of the outer tube 34 and the outer circumferential face of the inner heat exchanging tube 32, can be rapidly executed, and the temperature of the slurry can be easily adjusted.

Unlike the conventional heat exchanger including the fluororesin heat exchanging tube, the heat conductive area of the ceramic heat exchanging tube 32 of the heat exchanger 30 can be small, so that the size of the heat exchanger 30 can be small. Therefore, the residence time of the slurry in the heat exchanger 30 can be shorter, and the temperature of the machining liquid can be precisely adjusted.

Further, the ceramic heat exchanging tube 32 does not include boron (B); metal ions and boron (B) are not solved and included in the slurry, so that the surface of the silicon wafer 16 for semiconductor chips, etc. is not contaminated.

Figure 2:
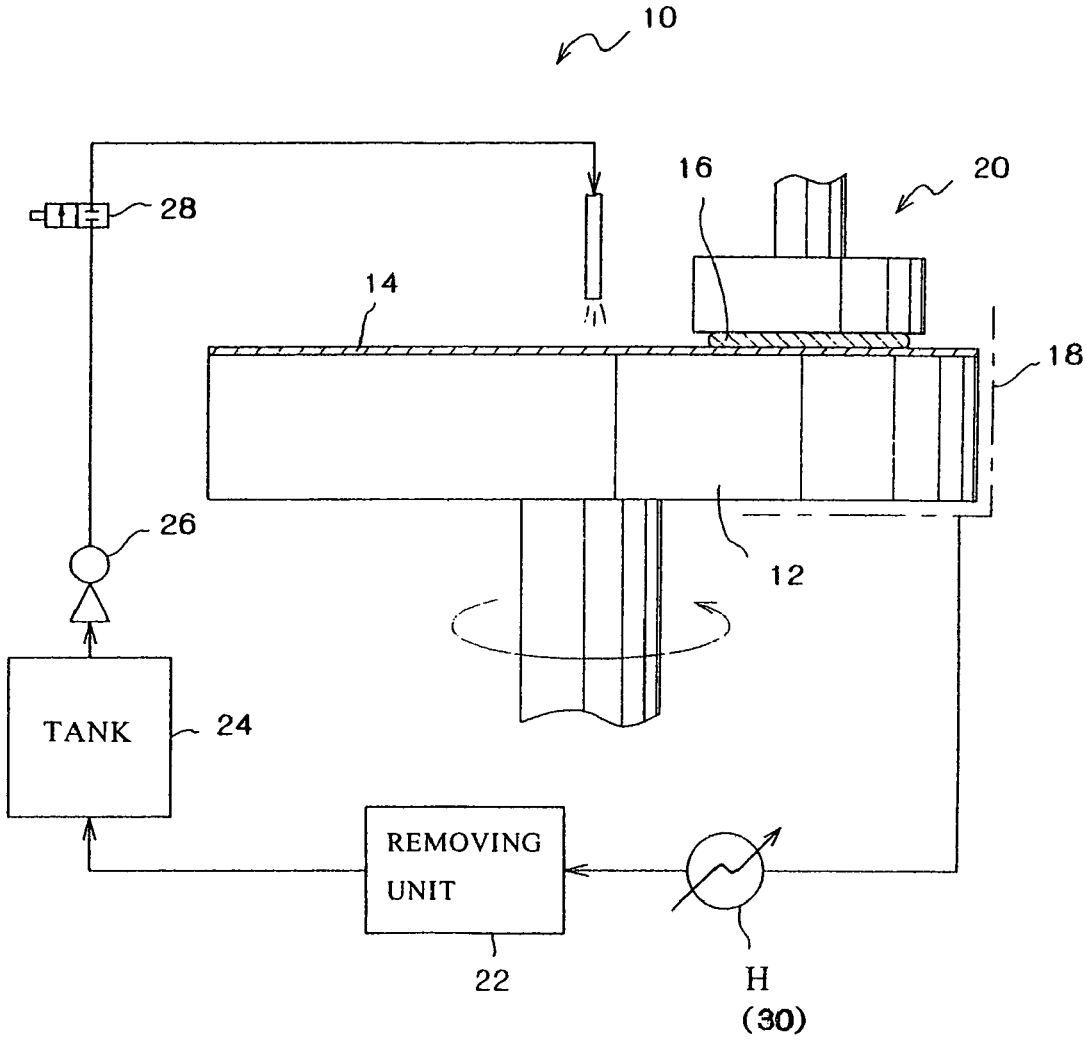
FIG. 2 is a schematic view of an abrasive machine including the heat exchanger in accordance with the present invention.

In the case of employing the heat exchanger 30 shown in FIG. 1 as the heat exchanger "H" of the abrasive machine 10 shown in FIG. 2, the lower surface of the wafer 16 to be abraded is pressed onto the abrasive cloth 14 of the abrasive pate 12 rotating by the abrasive head 20. The slurry stored in the tank 24 is dropped onto the abrasive cloth 14 so as to abrade the surface of the wafer 16. Then the used slurry is discharged from the abrasive cloth 14 to the collecting section 18, which is provided outside of the abrasive plate 12. The slurry discharged to the collecting section 18 has been heated by friction between the surface of the wafer 16 and the abrasive clothe 14, so the discharged slurry must be cooled by the heat exchanger 30 until reaching the prescribed temperature. Abraded dusts included in the cooled slurry are removed by the removing unit 22. The slurry, from which the abraded dusts have been removed, is stored in the tank 24, and the slurry in the tank 24 is supplied to the abrasive cloth 14 again, by the pump 26, via the electromagnetic valve 28.

By employing the heat exchanger 30 as the heat exchanger "H" of the abrasive machine 10 shown in FIG. 2, variations of the temperature of the slurry with respect to the object temperature can be limited within ±1° C. Further, the size of the heat exchanger 30 can be smaller, so the size of the abrasive machine 10 too can be smaller.

In the abrasive machine 10 shown in FIG. 2, the slurry discharged to the collecting section 18 is introduced to the tank 24 via the heat exchanger 30 and the removing unit 22. Further, the heat exchanger 30 may be employed in an abrasive machine shown in FIG. 3. In the abrasive machine shown in FIG. 3, the slurry discharged to the collecting section 18 is stored in the tank 24, and the slurry 24 in the tank 24 is circulated by a pump 29. The temperature of the slurry circulating is adjusted by the heat exchanger 30. The slurry, whose temperature has been adjusted to the prescribed temperature, is sent to the removing unit 22 by the pump 26 so as to remove abraded dusts. The slurry, from which the abraded dusts have been removed, is supplied to the abrasive cloth 14 again via the electromagnetic valve 28.

Figure 4:
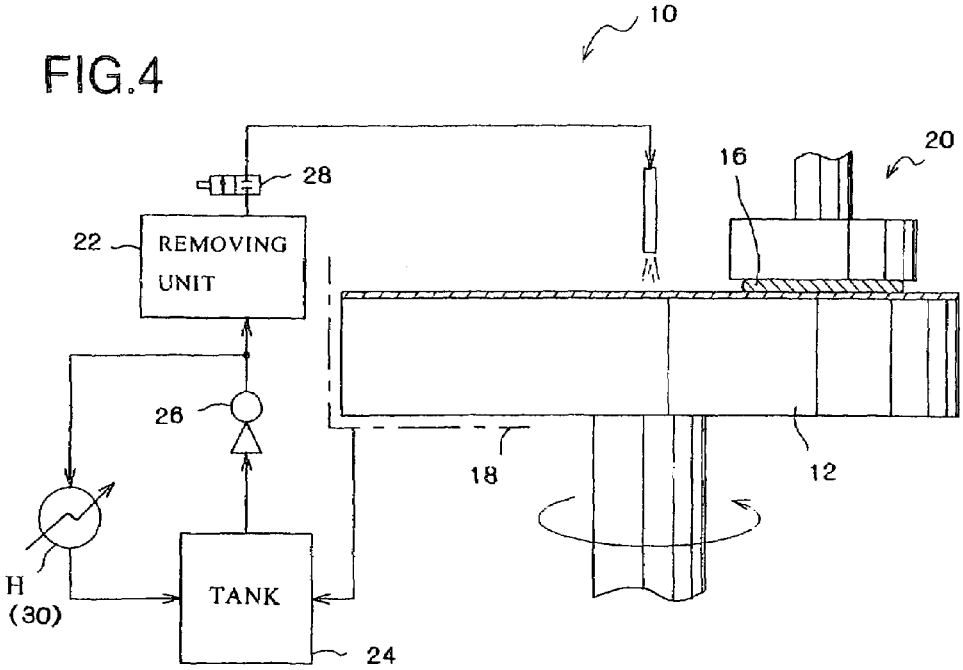
FIG. 4 is a schematic view of another abrasive machine including the heat exchanger in accordance with the present invention.
Figure 5:
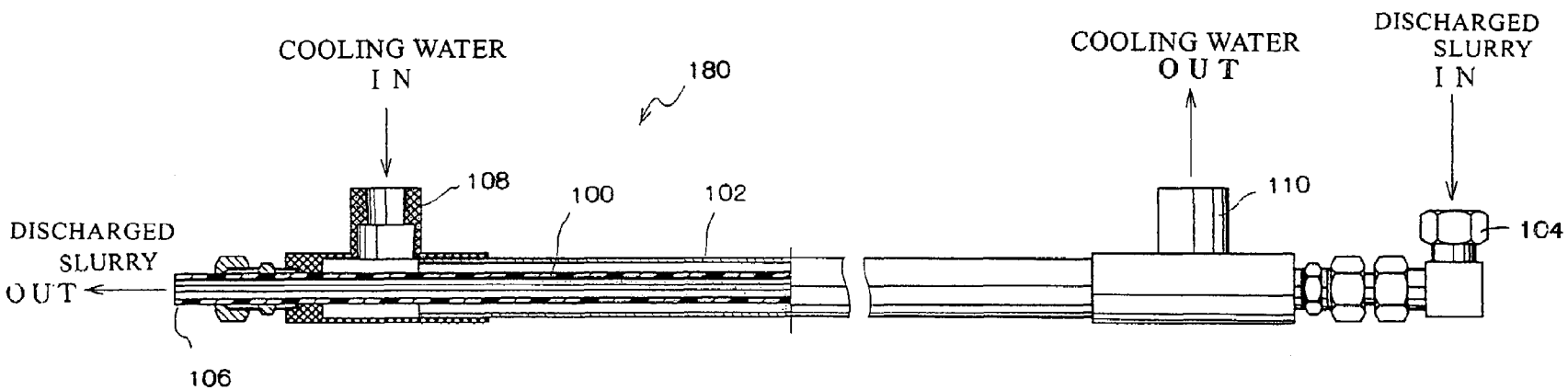
FIG.5 PRIOR ART
FIG. 5 is a partial sectional view of the conventional heat exchanger.

Further, the heat exchanger 30 may be employed in an abrasive machine shown in FIG. 4. In the abrasive machine shown in FIG. 4, the slurry discharged to the collecting section 18 is stored in the tank 24, and the slurry in the tank 24 is circulated by the pump 26. The temperature of the slurry circulating is adjusted by the heat exchanger 30. The slurry, whose temperature has been adjusted to the prescribed temperature, is sent to the removing unit 22 by the pump 26 so as to remove abraded dusts. The slurry, from which the abraded dusts have been removed, is supplied to the abrasive cloth 14 again via the electromagnetic valve 28.

Figure 3:
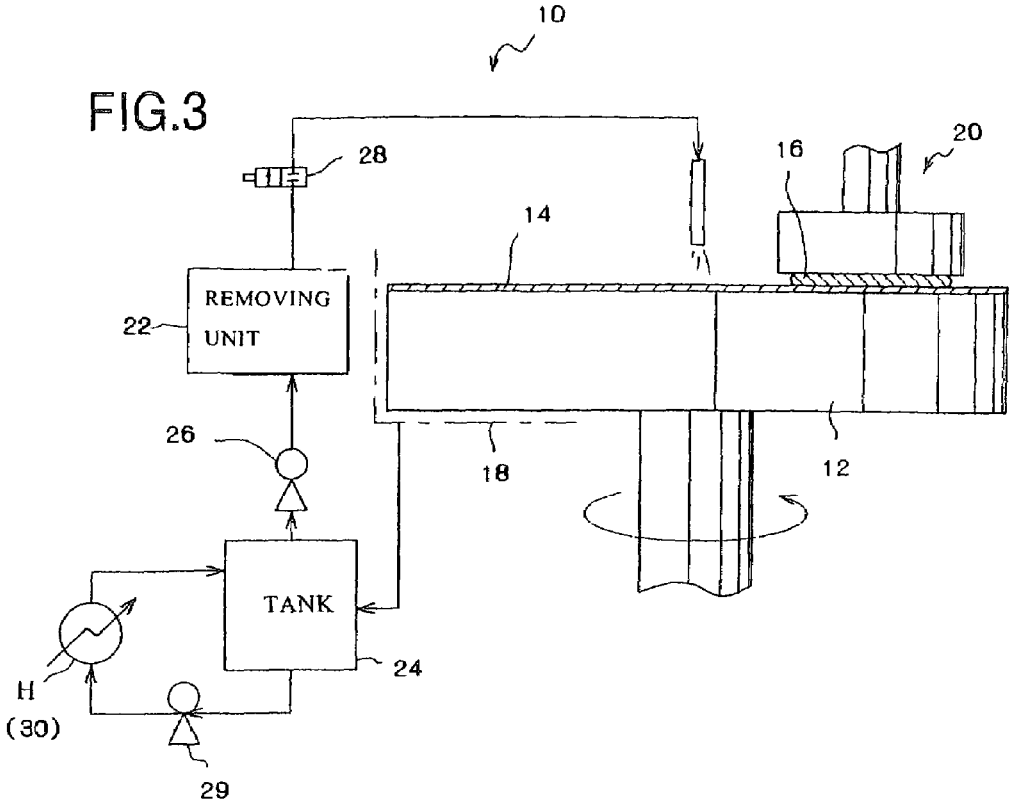
FIG. 3 is a schematic view of another abrasive machine including the heat exchanger in accordance with the present invention.

In the abrasive machines shown in FIGS. 2–4, the silicon wafers 16 are abraded as the work pieces. In the case of abrading, for example, a glass plate, the ceramic heat exchanging tube, which is made by baking silicon carbide (SiC), may include boron (B). Even if a very small amount of boron (B) is solved in the slurry, it does not have an adverse influence to the glass plate.

In the above described embodiments, the heat exchanger 30 is employed in the abrasive machines. But the heat exchanger 30 shown in FIG. 1 may be employed in cutting machines. Cutting machines use slurry including abrasive grains. The slurry is also circulated in the cutting machine as well as the abrasive machine.

Especially, in the case of a cutting machine for cutting a silicon ingot to form silicon wafers, the heat exchanger includes the ceramic heat exchanging tube. Preferably, the ceramic heat exchanging tube is made by baking silicon carbide (SiC) and does not include boron (B) as well as the heat exchanging tube 32 of the heat exchanger 30 shown in FIG. 1.

In the cutting machine including the heat exchanger 30 shown in FIG. 1, the temperature of the slurry for cutting can be precisely adjusted, and metal ions and boron (B) are not solved, from the heat exchanging tube, into the slurry. Therefore, products cut from an ingot, e.g., wafers, are not adversely affected.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The invention claimed is:

1. A method of adjusting temperature of a machining liquid after use in machining a workpiece, comprising:

constructing a ceramic heat exchanging tube such that metal ions do not solve out from the ceramic heat exchanging tube upon contact between the machining liquid and the ceramic heat exchanging tube, said contructing including baking a tube including silicon carbide (SiC) to form the ceramic heat exchanging tube, wherein the ceramic heat exchanging tube does not include boron;

feeding the machining liquid and a liquid for adjusting temperature of the machining liquid to a heat exchanger having the ceramic heat exchanging tube such that both the liquids are separated and the machining liquid contacts the ceramic heat exchanging tube; and adjusting the temperature of the machining liquid to a prescribed temperature by means of supplying the liquid for adjusting temperature to the ceramic heat exchanging tube.

2. The method according to claim 1, wherein both liquids flow in the heat exchanger as countercurrents.

3. The method according to claim 1, wherein the machining liquid passes through the ceramic heat exchanging tube.

4. The method according to claim 1, wherein the heat exchanger further includes an outer tube covering the ceramic heat exchanging tube.

5. The method according to claim 1, wherein the machining liquid is slurry for abrading or cutting the workpiece.

6. The method according to claim 1, wherein said feeding comprises directing the machining liquid in a first direction through the ceramic heat exchanging tube and directing the liquid for adjusting temperature in a second direction opposite to the first direction over the ceramic heat exchanging tube.

7. The method according to claim 1, wherein the heat exchanger further includes inlets and outlets for the machining liquid and the liquid for adjusting temperature, further comprising arranging the inlets and outlets such that the machining liquid and the liquid for adjusting temperature flow as countercurrents.

8. The method according to claim 1, wherein said feeding comprises directing the machining liquid into contact with an inner circumferential surface of the ceramic heat exchanging tube.

9. A method of adjusting temperature of a machining liquid after use in machining a workpiece, comprising:

constructing a ceramic heat exchanging tube such that metal ions do not solve out from the ceramic heat exchanging tube upon contact between the machining liquid and the ceramic heat exchanging tube, said constructing including baking a tube including silicon carbide (SiC) to form the ceramic heat exchanging tube, wherein the ceramic heat exchanging tube is made by baking silicon carbide (SiC) and resin only;

feeding the machining liquid and a liquid for adjusting temperature of the machining liquid to a heat exchanger having the ceramic heat exchanging tube such that both the liquids are separated and the machining liquid contacts the ceramic heat exchanging tube; and adjusting the temperature of the machining liquid to a prescribed temperature by means of supplying the liquid for adjusting temperature to the ceramic heat exchanger tube.

10. The method according to claim 9, wherein both liquids flow in the heat exchanger as countercurrents.

11. The method according to claim 9, wherein the heat exchanger further includes an outer tube covering the ceramic heat exchanging tube.

12. The method according to claim 9, wherein said feeding comprises directing the machining liquid in a first direction through the ceramic heat exchanging tube and directing the liquid for adjusting temperature in a second direction opposite to the first direction over the ceramic heat exchanging tube.

13. The method according to claim 9, wherein the heat exchanger further includes inlets and outlets for the machining liquid and the liquid for adjusting temperature, further comprising arranging the inlets and outlets such that the machining liquid and the liquid for adjusting temperature flow as countercurrents.

14. The method according to claim 9, wherein said feeding comprises directing the machining liquid into contact with an inner circumferential surface of the ceramic heat exchanging tube.

15. A method of adjusting temperature of a machining liquid after use in machining a workpiece, comprising:

constructing a ceramic heat exchanging tube such that metal ions do not solve out from the ceramic heat exchanging tube upon contact between the machining liquid and the ceramic heat exchanging tube, said constructing including forming a tube without boron and including silicon carbide (SiC) and baking the tube to form the ceramic heat exchanging tube;

feeding the machining liquid and a liquid for adjusting temperature of the machining liquid to a heat exchanger having the ceramic heat exchanging tube and in which both liquids are separated and the machining liquid contacts the ceramic heat exchanging tube; and adjusting the temperature of the machining liquid to a prescribed temperature by means of supplying the liquid for adjusting temperature to the ceramic heat exchanger tube.

16. The method according to claim 15, wherein the heat exchanger further includes an outer tube covering the ceramic heat exchanging tube.

17. The method according to claim 15, wherein said feeding comprises directing the machining liquid in a first direction through the ceramic heat exchanging tube and directing the liquid for adjusting temperature in a second direction opposite to the first direction over the ceramic heat exchanging tube.

18. The method according to claim 15, wherein the heat exchanger further includes inlets and outlets for the machining liquid and the liquid for adjusting temperature, further comprising arranging the inlets and outlets such that the machining liquid and the liquid for adjusting temperature flow as countercurrents.

19. The method according to claim 15, wherein said feeding comprises directing the machining liquid into contact with an inner circumferential surface of the ceramic heat exchanging tube.

20. A method of adjusting temperature of a machining liquid after use in machining a workpiece, comprising:

constructing a ceramic heat exchanging tube such that metal ions do not solve out from the ceramic heat exchanging tube upon contact between the machining liquid and the ceramic heat exchanging tube, said constructing including forming the ceramic heat exchanging tube from only silicon carbide and resin and baking the tube including the silicon carbide (SiC) to form the ceramic heat exchanging tube.

feeding the machining liquid and a liquid for adjusting temperature of the machining liquid to a heat exchanger having the ceramic heat exchanging tube and in which both liquids are separated and the machining liquid contacts the ceramic heat exchanging tube; and adjusting the temperature of the machining liquid to a prescribed temperature by means of supplying the liquid for adjusting temperature to the ceramic heat exchanger tube.

* * * * *